US005228299A

United States Patent [19]

Harrington et al.

[11] Patent Number: 5,228,299

[45] Date of Patent: Jul. 20, 1993

[54] CRYOPUMP WATER DRAIN

[75] Inventors: James E. Harrington, Acton; Arthur J. Camerlengo, Woburn, both of Mass.

[73] Assignee: Helix Technology Corporation, Mansfield, Mass.

[21] Appl. No.: 870,443

[22] Filed: Apr. 16, 1992

[51] Int. Cl.[5] ..... B01D 8/00

[52] U.S. Cl. ..... 62/55.5; 55/269; 417/901

[58] Field of Search ..... 62/55.5; 419/901; 55/269

[56] References Cited

U.S. PATENT DOCUMENTS

| | | | |
|---|---|---|---|
| 4,655,046 | 4/1987 | Eacobacci et al. | 62/55.5 |
| 4,718,240 | 1/1988 | Andeen et al. | 62/55.5 |
| 4,724,677 | 2/1988 | Foster | 417/901 |
| 4,834,136 | 5/1989 | Bourke et al. | 62/55.5 |

FOREIGN PATENT DOCUMENTS

| | | |
|---|---|---|
| 3013582 | 10/1981 | Fed. Rep. of Germany . |
| 8480 | 1/1985 | Japan . |
| 53684 | 3/1985 | Japan . |
| 3177 | 1/1987 | Japan . |
| 652804 | 11/1985 | Switzerland . |

*Primary Examiner*—Ronald C. Capossela

*Attorney, Agent, or Firm*—Hamilton, Brook, Smith & Reynolds

[57] ABSTRACT

A cryopump includes a sloped draining surface for receiving liquids released from cyropumping surfaces. The liquids are collected in an exhaust port and released outside the cryopump vacuum vessel. A pressure relief valve coupled to the exhaust port exhausts gases released by the pumping surfaces after warming. The cryopump further includes a drain filter assembly connected to the exhaust port for collecting debris and removing liquid that is released from the cryopumping surfaces. A purge gas tube facilitates the removal of large quantities of liquid in the cryopump.

20 Claims, 3 Drawing Sheets

CRYOPUMP WATER DRAIN

BACKGROUND OF THE INVENTION

This invention relates generally to the field of cryopumps. Cryopumps condense and adsorb gases on cryopumping surfaces cooled to cryogenic temperatures by a cryogenic refrigerator.

Typically, the cryopumping surfaces include a low temperature array operating in the range of about 4° K. to about 25° K. and a high temperature array operating in the range of about 70° K. to about 130° K. The primary pumping surface is the low temperature array. The high temperature array is positioned between the primary pumping surface and a work chamber to be evacuated and closes a radiation shield which surrounds the low temperature array.

High boiling point gases such as water vapor are condensed on the high temperature array. Lower boiling point gases pass through the high temperature array to the low temperature array wherein they are condensed. The lower temperature array may include an adsorbent such as charcoal or a molecular sieve to remove very low boiling point gases such as hydrogen, helium, and neon. The above condensation and adsorption ensures a high vacuum in the surrounding vessel and at an adjoining processing or work chamber.

Once the high vacuum has been established, work pieces may be moved into and out of the work chamber through partially evacuated load locks. Each time the work chamber is opened, additional gases enter therethrough. These gases are then condensed onto the cryopumping surfaces to evacuate the chamber and provide low pressure for processing. Also, processing gases introduced with the work chamber are condensed onto the cryopumping surfaces.

After several days or weeks of continued processing, the gases that condense and adsorb on the cryopanels begin to saturate the cryopump. It is necessary to release trapped gases by regeneration or defrosting, since the cryopumps are capture pumps and not throughput pumps. During regeneration the cryopump is shut down temporarily so that the cryopumping surfaces warm up and release the trapped gases. The released gases are then purged from the work chamber.

A pressure relief valve is used to avoid dangerous levels of high pressure in the cryopump during regeneration. Typically, the pressure relief valve has a spring-loaded valve held against an O-ring seal which opens when the pressure in the cryopump chamber exceeds about 3 pounds per square inch gauge (PSIG). A filter standpipe may be provided to capture debris (i.e. process debris and particles of charcoal from the adsorber) before it can accumulate on the O-ring seal. The screen filter standpipe is made of porous material which allows the free flow of gas, water, and liquid cryogens therethrough while retaining contaminating debris within the vacuum vessel. If debris were to reach and collect on the O-ring seal, pump-down and start-up would be virtually impossible without cleaning.

To warm up the cryopump during regeneration, a warm gas purge may be performed to decrease warmup time. A warm gas purge warms up both the low temperature array and the high temperature array and ensures that substantially all gases are flushed out of the cryopump. Warming of the cryopump may be supplemented by an electric heater on the refrigerator.

After warmup, the cryopump is rough-pumped to obtain a pressure low enough for cooldown. During the cooldown, all valves are closed so that the cryopumping surfaces can condense or adsorb all residual gases within the cryopump. A high vacuum is obtained by first pumping water, then argon, and nitrogen, etc.

SUMMARY OF THE INVENTION

Presently, large quantities of water often remain in the cryopump vacuum vessel after the warm up. The water can cause thermocouple pressure gauges and connectors to temperature sensors to short. Also, any water drawn into the roughing pump can damage the pump. Water which remains after roughing causes an incomplete regeneration which means that the cryopump will have to be regenerated more often. Thus, there is a need for a cryopump that ensures that water be removed from the vacuum vessel during regeneration.

In accordance with a preferred embodiment of the present invention, there is provided a cryopump vacuum vessel having therein a cryogenic refrigerator and cryopumping surfaces cooled by the refrigerator for condensing and adsorbing gases thereon. The cryopump includes a sloped surface for draining substantially all liquid released from the cryopumping surfaces to an exhaust port. A pressure relief valve is coupled to the exhaust port for exhausting fluids, gases and liquids released by the cryopumping surfaces after warming.

In a preferred embodiment of the present invention, a radiation shield surrounding the cryopumping surface has a funneled bottom surface sloping towards a drain hole. Preferably, the drain hole has a downwardly directed lip which ensures that all liquid falls from the radiation shield. The drain hole directs the liquid into a drain filter assembly which is coupled to the exhaust port.

The drain filter assembly includes a conically shaped screen that filters and controls the flow of liquid into a filter standpipe. An adhesion rod coupled to the conically shaped screen extends into the filter standpipe along the length thereof. The adhesion rod has a surface tension by which liquid flowing through the conically shape screen adheres thereto, keeping the liquid centered in the filter standpipe. Thus, the liquid is prevented from spraying out through the screen filter standpipe onto the lower surface of the vacuum vessel.

A cap may be placed over the conically shaped screen to direct liquid away from the standpipe in the event of an overflow, thus preventing any unfiltered liquid from passing into the filter standpipe. A plurality of support posts, each having an upper end and a lower end, are coupled to the cap at each respective upper end. An annular element surrounds the filter standpipe and is coupled to the lower ends of the plurality of support posts at one side. A plurality of bolt posts extending upward from the bottom of the vessel are secured to the annular element opposite the side to which the support posts are coupled.

Preferably, a purge gas tube extends upwardly from the bottom surface of the vacuum vessel through the bottom surface of the radiation shield for enhancing the removal of liquids from the cryopumping surfaces. The purge gas tube has at least two transverse holes or ports therein which are directed to blow liquid on the radiation shield toward a drain hole. An upwardly directed hole blows purge gas toward the cryopumping surfaces.

Additional holes at the lower end of the tube blow liquid towards the filter standpipe.

The present invention further includes a preferred method of removing liquids from a vacuum vessel. Liquids released from cryopumping surfaces are drained on a sloped surface. The liquids are directed to a lower end of the sloped surface into an exhaust port and removed outside the vessel through a pressure relief valve.

In a more specific method, liquid released from the cyropumping surfaces is deposited on a radiation shield having a funnel-shaped bottom. The liquid is drained from the bottom of the funnel-shaped radiation shield into a drain filter and screen filter standpipe for removal from the vacuum vessel.

While the present invention will hereinafter be described in connection with a preferred embodiment and method of use, it will be understood that it is not intended to limit the invention to this embodiment. Instead, it is intended to cover all alternatives, modifications, and equivalents, as may be included within the spirit and scope of the invention as defined by the appended claims.

DETAILED DESCRIPTION OF THE PREFERRED EMBODIMENT

Figure 1:
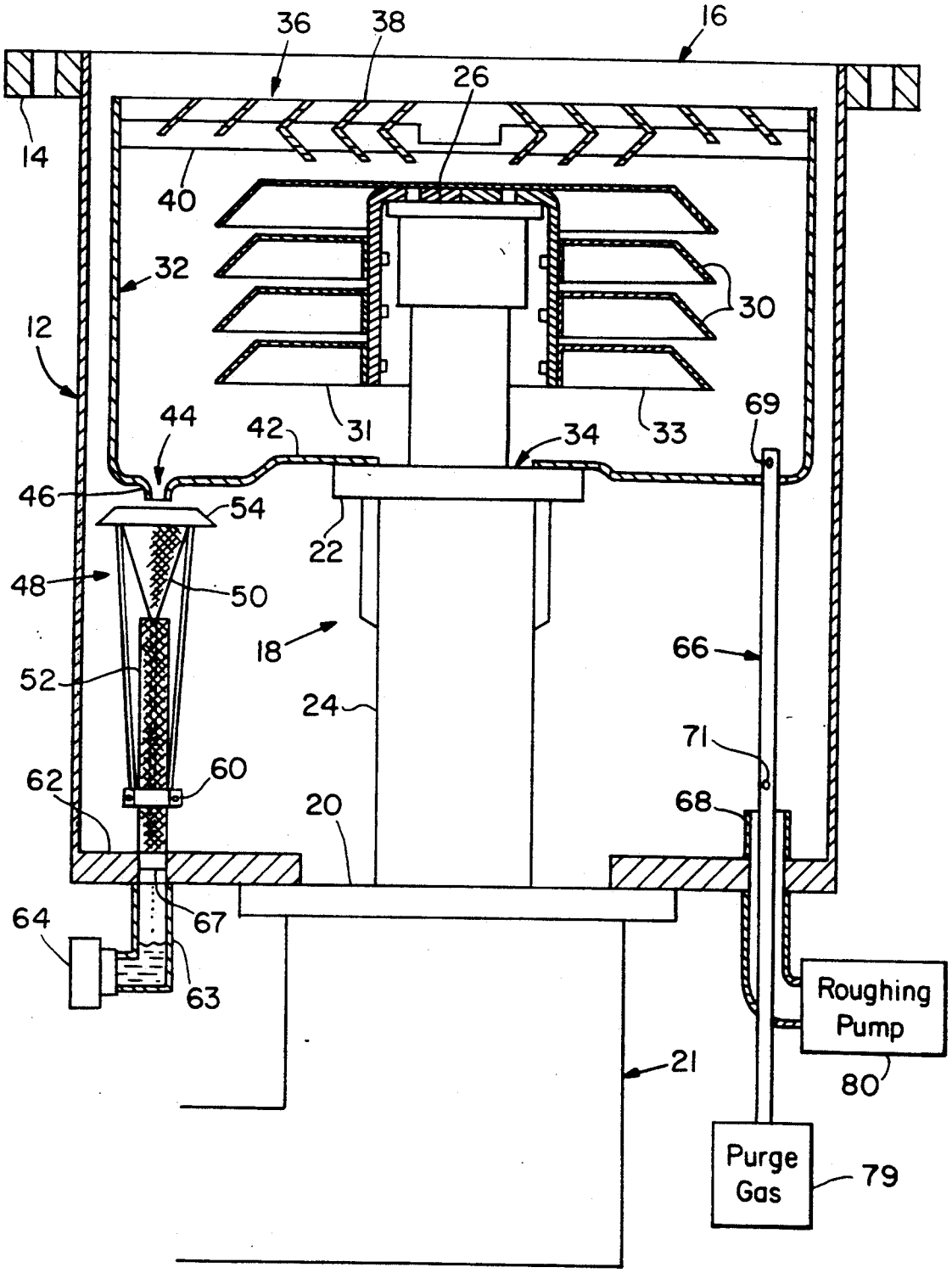
FIG. 1 is a cross-sectional view of a cryopump embodied in the present invention.

The cryopump of FIG. 1 includes a main housing 12 which is mounted to a work chamber or a valve housing along a flange 14. A front opening 16 in the cryopump housing 12 communicates with a circular opening in the work chamber or valve housing. A refrigerator 18 having a two stage cold finger protrudes into the housing 12 through an openinq 20. The refrigerator is a Gifford-McMahon refrigerator but others may be used. The two stage Gifford-McMahon refrigerator is driven by a motor 21. During each pumping cycle, helium gas is introduced into a cold head of the cold finger under pressure through a pressure line (not shown). A heat sink 22 is mounted at the cold end of a first stage 24 of the refrigerator. Similarly, a second heat sink 26 is mounted to the cold end of a second stage 28 of the refrigerator.

The refrigeration system is designed so that the helium cools the first stage 24 to a temperature of about 80° K. and the second stage 28 to a temperature of about 15° K. Random molecular motion brings the helium gas molecules into contact with the stages ensuring condensation and/or adsorbtion.

The primary purpose of the first stage 24 is to condense water vapor which is typically the bulk of the gas load. A temperature of about 80° K. enables cryocondensation to occur, which reduces the pressure in the vessel causing the gas molecules to adhere to the array surface of the first stage 24. Helium, neon, and hydrogen gases cannot be removed by cryocondensation since their molecular flux and velocity are too great, which prevents them from adhering to the cryo-cooled surfaces. These gases are removed at the second stage 28 through cryosorption.

The second stage 28 removes hydrogen, helium, and neon by providing a colder temperature and a greater surface area wherein the pumped molecules are farther apart and less likely to interact. The second stage 28 includes an array of baffles 30 mounted to the heat sink 26. The array of baffles are formed of two separate groups of semi-circular baffles 31 and 33 mounted to respective brackets 35 and 37 which are mounted to heat sink 26. Charcoal adsorbent is epoxied to the top surfaces of baffles 31 and 33. This assembly ensures that the second stage 28 condenses and adsorbs gases. The second stage may further include a heater assembly and a temperature sensor to monitor the cryopump as disclosed in U.S. Pat. No. 4,918,930.

A radiation shield 32 is mounted to heat sink 22 of the first stage. The second stage 28 of the cold finger extends through an opening 34 of radiation shield 32. The radiation shield 32 surrounds the primary cryopanel array 30 to the rear and at the sides, to minimize heating. The temperature of the radiation shield ranges from about 100° K. at the heat sink 22 to about 130° K. adjacent to the opening 16.

A frontal cryopanel array 36 serves as both a radiation shield for the primary cryopanel array 30 of the second stage 28 and as a cryopumping surface for higher boiling temperature gases such as water vapor. The cryopanel array 36 comprises a circular array of concentric louvers and chevrons 38 joined by spoke-like plates 40. The cryopanel 36 should not be limited to circular concentric components. It is important that the cryopanel 36 have a low temperature for water condensation and act as a radiant heat shield while providing a path for lower boiling temperature gases to the primary cryopanel 30 of the second stage without condensing those gases.

As mentioned previously, it is necessary to regenerate cryopump after several days or weeks of continued processing. To release the trapped gases that are condensed and absorbed on the cryopanels, the refrigerator 18 is shut off. Turning the refrigerator 18 off causes the cryopump to warmup and desorb liquid cryogens and water vapor from its primary cryopumping panels.

The liquid being released from the primary cryopumping panel "rains" or drains onto a bottom surface 42 of the radiation shield. The bottom surface of the radiation shield is funnel-shaped so that liquid "raining" on the surface is directed down the funnel. The bottom of the funnel-shaped radiation shield slopes towards a drain hole 44. The drain hole 44 has a downwardly directed lip 46 extending therefrom to maximize the amount of liquid removed from the bottom surface 42. The downwardly directed lip prevents the liquid from adhering to and flowing along the bottom surface of the radiation shield and thus ensures that substantially all liquid flowing through the drain hole falls.

Figure 2:
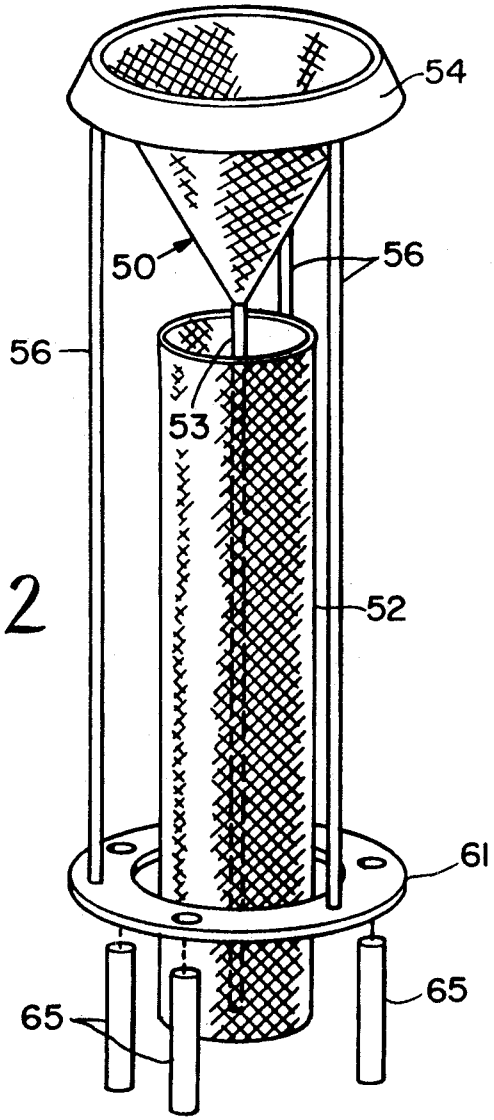
FIG. 2 is a cross-sectional view of an alterative drain filter assembly.

The liquid from the drain hole 44 is transferred to a drain filter assembly 48 shown in FIGS. 1 and 2. The drain filter assembly includes a conically-shaped screen 50, a filter standpipe 52, a cap 54 placed over the conically-shaped screen, an adhesion rod 53 extending downward from the bottom of the conically-shaped screen through the center of the filter standpipe, a plurality of support rods or posts 56 extending downward from the cap, and a clamp 60 securing the support rods.

The drain filter assembly 48 collects the liquid deposited on bottom surface 42. The conically shaped screen 50 controls the flow of liquid released from drain hole 44 into a filter standpipe 52 and removes process debris.

The cap 54 is placed underneath drain hole 44 and over the conically shaped screen 50, for directing liquid away from the filter standpipe 52 in the event of an overflow. During an overflow, liquid will not be able to enter the filter standpipe without filtering. The cap 54 directs the overflowing liquid away from the filter standpipe to the bottom of the vessel. Thus, unfiltered liquid is prevented from passing into the filtered standpipe. The liquid that does not pass through the filtered standpipe falls to the bottom of the vessel, where it drains through the standpipe or is evaporated by purge gas being blown from the purge tube 66.

The adhesion rod 53 extends from the conically shaped screen downward through the center of the filter standpipe 52. The adhesion rod has a surface tension wherein liquid flowing through the conically-shape screen adheres to the adhesion rod, preventing liquid from spraying toward and through the filter standpipe and contacting the lower surface 62 of the cryopump vacuum vessel.

FIG. 2 shows a cross-sectional view of an alternative drain filter assembly. This drain filter assembly further includes a plurality of bolt rods or posts 65 extending upward from the bottom of the vessel, and an annulus 61 surrounding the filter standpipe for connecting the support rods and the bolt rods.

The support rods 56 have an upper end and a lower end which are connected to cap 54 at their upper ends and to the annulus 61 at their lower ends. The bolts rods 65 are welded to the bottom of the vessel and are secured to the annulus 61 at a side opposite the connection between the annulus and the support rods. Preferably, the rods are made of stainless steel.

The filter standpipe 52 is connected to an exhaust port 67 to an exhaust conduit 63, through which substantially all liquid is released outside the cryopump through a pressure relief valve 64. The screen filter standpipe is made of porous material which allows the free flow of gas, water, and liquid cryogens therethrough while retaining contaminating debris within the vacuum vessel.

During the warmup phase of regeneration, the increasing temperatures within the cryopump vacuum vessel cause gas to release which causes the pressure in the vessel to increase. To prevent dangerous pressure levels within the cryopump during warmup, the pressure relief valve 64 exhausts gases therefrom as pressure levels reach 3 PSIG. By using the conventional exhaust gas port with pressure relief valves as the liquid drain port, a passive drain assembly is obtained. That is, the valve 64 which serves as a drain valve is opened by the pressure differential resulting from the release of gases. The gases being exhausted through the valve carry out the drained liquid as well.

A purge gas tube 66 is shown in FIG. 1 extending upwardly from the bottom surface 62 of the vacuum vessel through the bottom surface 42 of the radiation shield. The purge tube is generally at an ambient temperature and the radiation shield is at a temperature ranging from about 80° K. to about 120° K. Thus, it is necessary to have a gap between the purge tube and the radiation shield 32 so that a thermal short does not occur. The primary purpose of the conventional purge gas tube 66 is to enhance the removal of liquid away from the primary cryopumping surface of the second stage 28. This purpose is served by an orifice 82 shown in FIG. 3 at the top of the tube which blows gas upwardly from a gas source 79. The purge gas tube 66 also blows purge gas through side ports 69 and acts as an air broom whisking the bulk of the water vapor and liquid cryogens away from the tube and surrounding gap towards the drain hole 44. Also, purge gas from line 79 is blown from lower side ports 71 towards the bottom of the vessel. The warm gas causes liquid at the bottom of the vessel to evaporate and create a dry area. Preferably, there are two upper ports 69 and two lower ports 71, but more than two can be used. This technique greatly improves the speed and quality of regeneration. Connected at the bottom of the purge tube 66 is a standoff 68. The standoff prevents water from draining in the roughing pump 80. Other standpipes may be provided about gauges to prevent water damage.

Figure 3:
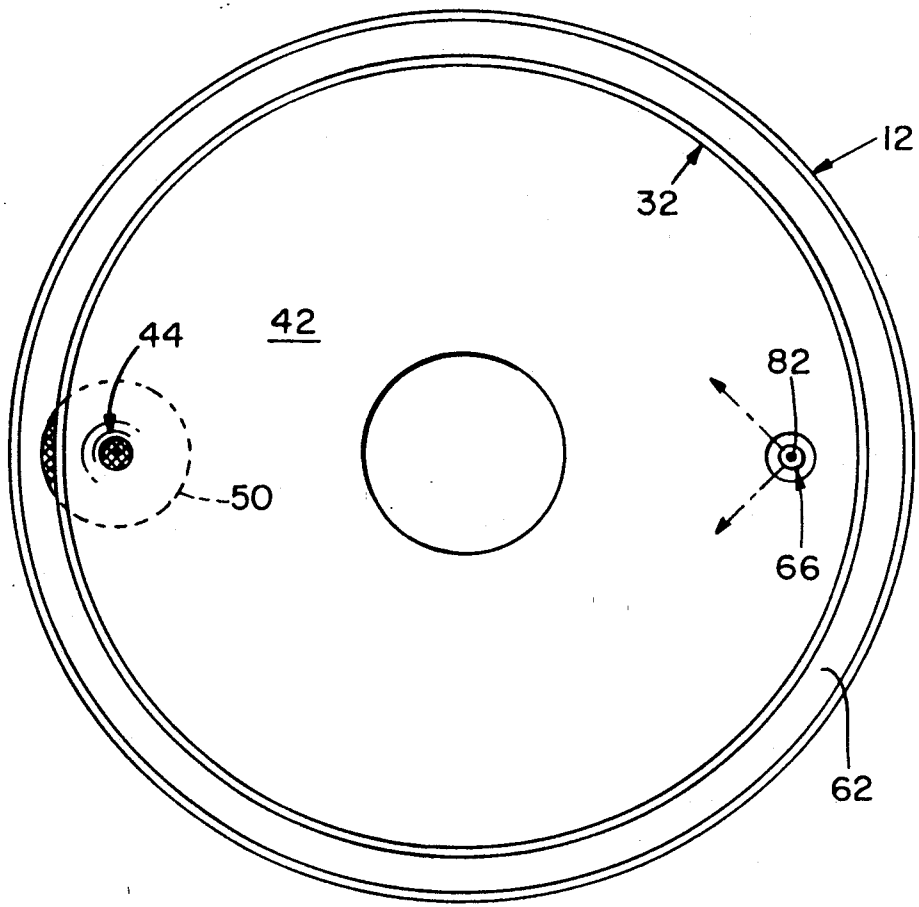
FIG. 3 is a top view of the purge gas port tube embodied in the present invention.

FIG. 3 shows a top view of the purge gas tube in the vacuum vessel. The purge gas tube has two holes 69, that serve as nozzles for directing liquid towards drain hole 44. There may be more than two holes but two is preferred to enhance liquid removal. The holes should be placed at an angle of about 45° relative to each other to maximize a better sweep of the area.

The small orifice 82 on top of the purge gas tube is in a plug at the end of the tube. The plug allows for a relatively small orifice 82 with the tube being of sufficient diameter to provide for flow of purge gas to all orifices, a sufficient pressure differential being maintained across all five orifices to cause gas to be blown therethrough.

Figure 4:
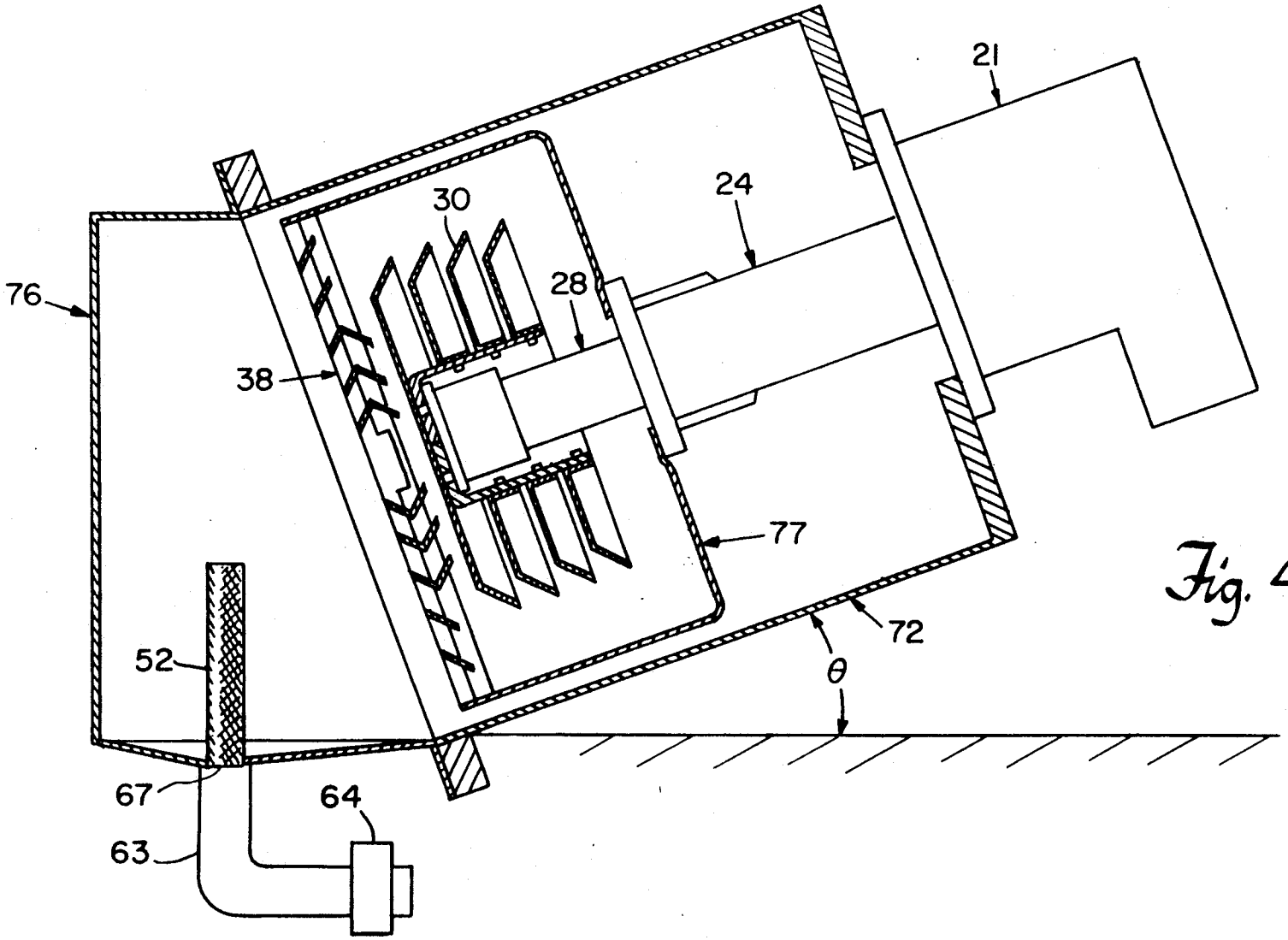
FIG. 4 is a cross-sectional view of an alternative side mounted cryopump.

FIG. 4 shows another embodiment for removing liquid from a cryopump vacuum vessel. A liquid accumulator 76 is mounted to the side of a chamber to receive liquid released from the cryopumping surfaces. This cryopump comprises a vacuum vessel having a surface 72 sloped at an angle, $\theta$, relative to the liquid accumulator 76. The liquids released from the cryopumping panels "rain" on the surface of a radiation shield 77 which is similarly sloped and are directed down the sloped surface 77 towards the liquid accumulator 76. The liquid accumulator has a funneled bottom surface that collects the released liquid. Then the liquid is directed towards exhaust port 67 and exhaust conduit 63 to be removed from the vessel. The liquid passes through the filter screen standpipe 52 which collects debris. Thus, substantially all liquid that is released from the primary cyropumping surface is collected at the exhaust port and removed therethrough. A pressure relief valve 64 is connected to the exhaust conduit 63 to exhaust gases and liquid released from the cryopumping surfaces.

An extreme angle, $\theta$, of the sloped surface 72 is shown for illustration but the angle is preferably in the range from about 0.5° to about 1.5°.

It is apparent that there has been provided, in accordance with the present invention, a cryopump vacuum vessel that removes large quantities of water therefrom. Thus, regeneration is faster and more efficient.

While the invention has been particularly shown and described in conjunction with a preferred embodiment thereof, it will be understood that many alternatives, modifications, and variation will be apparent to those skilled in the art without departing from the spirit and scope of the invention as defined by the appended claims.

We claim:

1. A cryopump having a cryogenic refrigerator and cryopumping surfaces cooled by the refrigerator for condensing gases thereon, the cryopump comprising:

a vacuum housing enclosing cryopumping surfaces and having a frontal opening;

a liquid accumulator to which the cryopump housing is mounted at its frontal opening such that the housing is angled and cryopumping surfaces are angled to drain liquid released therefrom to the accumulator;

an exhaust port located at a base of the accumulator; and a pressure relief valve coupled to the exhaust port for exhausting fluids released by the cryopumping surfaces after warming.

2. A cryopump according to claim 1, further comprising a filter standpipe coupled to the exhaust port for removing debris.

3. A cryopump comprising:

a vacuum vessel;

a refrigerator;

cryopumping surfaces cooled by the refrigerator for condensing gases in the vessel;

an exhaust port in a base of the vacuum vessel;

a radiation shield surrounding the cryopumping surfaces, the radiation shield having a funneled bottom surface sloping towards a drain hole in the shield;

a drain filter assembly under neath the drain hole for transferring liquid to the exhaust port and removing debris from the liquid;

a pressure relief valve coupled to the exhaust port for exhausting gases released by the cryopumping surfaces; and a purge gas tube extending upwardly from a bottom surface of the vacuum vessel through the bottom surface of the sloped radiation shield for emitting purge gas in the vessel, the purge gas tube being located away from the drain hole and having side ports for directing liquid towards the drain hole.

4. A cryopump according to claim 3, wherein the drain filter assembly comprises:

a conically shaped screen controlling the flow of liquid released from the cryopumping surfaces; and a filter standpipe underneath the conically-shaped screen extending upwardly from the exhaust port.

5. A cryopump according to claim 4, further comprising:

an adhesion rod extending downwardly from the conically shaped screen into the filter standpipe, the adhesion rod having a surface tension wherein liquid flowing through the screen adheres to the adhesion rod, preventing liquid from passing through the sides of the filter standpipe onto the lower surface of the vacuum vessel.

6. A cryopump according to claim 5 further comprising;

a cap placed over the conically shaped screen;

a plurality of support rods each having an upper end and a lower end, the upper ends being coupled to the cap;

a plurality of bolt rods having an upper end and a lower end, the lower ends being secured to the bottom of the vacuum vessel; and an annulus element surrounding the filter standpipe, wherein the lower ends of the plurality of support rods are secured to one side of the annulus and the upper ends of the plurality of bolt rods are secured at an opposite side.

7. A cryopump according to claim 3, wherein the drain hole has a downwardly directed lip ensuring that substantially all liquid falls from the radiation shield.

8. A cryopump according to claim 3, wherein the purge gas tube has at least two holes therein for emitting purge gas into the vacuum vessel.

9. A cryopump having a cryogenic refrigerator and cryopumping surfaces cooled by the refrigerator for condensing gases, the cryopump comprising:

a radiation shield surrounding the cyropumping surfaces, the radiation shield having a funnel shaped bottom surface for collecting liquids released from the cryopumping surfaces;

a drain hole at the bottom of the funneled radiation shield for removing liquid;

a purge gas tube extending upwardly through the radiation shield for emitting purge gas, the purge gas tube being located away from the drain hole and having side parts for directing liquid towards the drain hole;

an exhaust port for receiving substantially all liquid released from the drain hole; and a pressure relief valve coupled to the exhaust port for exhausting gases released by the cryopanel surfaces after warming.

10. A method of removing liquids from a cryopump vacuum vessel having a cryogenic refrigerator mounted to the vacuum vessel, and cryopumping surfaces cooled by the cryogenic refrigerator for condensing gases thereon, the method comprising the steps of:

mounting the vacuum vessel to an accumulator at an angle to drain liquid from within the vacuum vessel to the accumulator;

draining liquids released form the cryopumping surfaces on a sloped surface;

directing the liquids to a lower end of the sloped surface into the accumulator; and removing the liquids and gases outside the vacuum vessel through a pressure relief valve coupled to an exhaust port located at the base of the liquid accumulator.

11. A method of removing liquid in a cryopump having a vacuum vessel, a cryogenic refrigerator mounted to the vacuum vessel, cryopumping surfaces cooled by the cryogenic refrigerator for condensing gases thereon, and a radiation shield surround the cryopumping surfaces, the method comprising the steps of:

draining liquids released from the cryopumping surfaces along a funnel-shaped radiation shield having a drain hole;

directing the liquids towards the drain hole with purge gas from a purge gas tube, the purge gas tube being located away from the drain hole;

transferring the liquid from the drain hole through a drain filter; and releasing the liquids from the drain filter outside the vacuum vessel through a pressure relief valve.

12. A cryopump comprising:

a vacuum vessel;

a refrigerator;

cryopumping surfaces cooled by the refrigerator for condensing gases in the vessel;

an exhaust port in a base of the vacuum vessel;

a radiation shield surrounding the cryopumping surfaces, the radiation shield having a funneled bottom surface sloping towards a drain hole in the shield;

a drain filter assembly underneath the drain hole for transferring liquid to the exhaust port and removing debris form the liquid, the drain filter assembly comprising:

a conically shaped screen controlling the flow of liquid released from the cryopumping surfaces; and a filter standpipe underneath the conically-shaped screen extending upwardly from the exhaust port;

a pressure relief valve coupled to the exhaust port for exhausting gases released by the cryopumping surfaces; and a purge gas tube extending upwardly from a bottom surface of the vacuum vessel through the bottom surface of the sloped radiation shield for emitting purge gas in the vessel, the purge gas directing liquid towards the drain hole.

13. A cryopump according to claim 12, further comprising:

an adhesion rod extending downwardly from the conically shaped screen into the filter standpipe, the adhesion rod having a surface tension wherein liquid flowing through the screen adheres to the adhesion rod, preventing liquid from passing through the sides of the filter standpipe onto the lower surface of the vacuum vessel.

14. A cryopump according to claim 13 further comprising:

a cap placed over the conically shaped screen;

a plurality of support rods each having an upper end and a lower end, the upper ends being coupled to the cap;

a plurality of bolt rods having an upper end and a lower end, the lower ends being secured to the bottom of the vacuum vessel; and an annulus element surround the filter standpipe, wherein the lower ends of the plurality of support rods are secured to one side of the annulus and the upper ends of the plurality of bolt rods are secured at an opposite side.

15. A cryopump comprising:

a vacuum vessel;

a refrigerator;

cryopumping surfaces cooled by the refrigerator for condensing gases in the vessel;

an exhaust port in a base of the vacuum vessel;

a radiation shield surrounding the cyropumping surfaces, the radiation shield having a funneled bottom surface sloping towards a drain hole in the shield, the drain hole having a downwardly directed lip ensuring that substantially all liquid falls from the radiation shield;

a drain filter assembly underneath the drain hole for transferring liquid to the exhaust port and removing debris from the liquid;

a pressure relief valve coupled to the exhaust port for exhausting gases released by the cryopumping surfaces; and a purge gas tube extending upwardly from a bottom surface of the vacuum vessel through the bottom surface of the sloped radiation shield for emitting purge gas in the vessel, the purge gas directing liquid towards the drain hole.

16. A cryopump according to claim 15, wherein the drain filter assembly comprises:

a conically shaped screen controlling the flow of liquid released from the cryopumping surfaces; and a filter standpipe underneath the conically-shaped screen extending upwardly from the exhaust port.

17. A cryopump according to claim 16, further comprising:

an adhesion rod extending downwardly from the conically shaped screen into the filter standpipe, the adhesion rod having a surface tension wherein liquid flowing through the screen adheres to the adhesion rod, preventing liquid from passing through the sides of the filter standpipe onto the lower surface of the vacuum vessel.

18. A cryopump comprising:

a vacuum vessel;

a refrigerator;

cryopumping surfaces cooled by the refrigerator for condensing gases in the vessel;

an exhaust port in a base of the vacuum vessel;

a radiation shield surrounding the cryopumping surfaces, the radiation shield having a funneled bottom surface sloping towards a drain hole int he shield;

a drain filter assembly underneath the drain hole for transferring liquid to the exhaust port and removing debris from the liquid;

a pressure relief valve coupled to the exhaust port for exhausting gases released by the cryopumping surfaces; and a purge gas tube, having at least two holes therein, extending upwardly from a bottom surface of the vacuum vessel through the bottom surface of the sloped radiation shield for emitting purge gas into the vacuum vessel, the purge gas directing liquid towards the drain hole.

19. A cryopump comprising:

a vacuum vessel;

a refrigerator;

cryopumping surfaces cooled by the refrigerator for condensing gases in the vessel;

an exhaust port in a base of the vacuum vessel;

a radiation shield surrounding the cryopumping surfaces, the radiation shield having a funneled bottom surface sloping towards a drain hole in the shield;

a drain filter assembly underneath the drain hole for transferring liquid to the exhaust port and removing debris from the liquid, the drain filter assembly comprising:

a conically shaped screen controlling the flow of liquid released from the cryopumping surfaces; and a filter standpipe underneath the conically-shaped screen extending upwardly from the exhaust port; and a pressure relief valve coupled to the exhaust port for exhausting gases released by the cryopumping surfaces.

20. A cryopump according to claim 19, further comprising:

an adhesion rod extending downwardly from the conically shaped screen into the filter standpipe, the adhesion rod having a surface tension wherein liquid flowing through the screen adheres to the adhesion rod, preventing liquid form passing through the sides of the filter standpipe onto the lower surface of the vacuum vessel.

* * * * *